US009212103B2

(12) United States Patent
Coppedge et al.

(10) Patent No.: US 9,212,103 B2
(45) Date of Patent: Dec. 15, 2015

(54) PYROTECHNIC PRESSURE ACCUMULATOR

(71) Applicant: Bastion Technologies, Inc., Houston, TX (US)

(72) Inventors: Charles Don Coppedge, Houston, TX (US); Dewey James Louvier, Houston, TX (US); Anna Azzolari Ronalds, Houston, TX (US); Hildebrand A. Rumann, League City, TX (US)

(73) Assignee: Bastion Technologies, Inc., Houston, TX (US)

( * ) Notice: Subject to any disclaimer, the term of this patent is extended or adjusted under 35 U.S.C. 154(b) by 67 days.

(21) Appl. No.: 13/776,268

(22) Filed: Feb. 25, 2013

(65) Prior Publication Data

US 2013/0220161 A1 Aug. 29, 2013

Related U.S. Application Data

(60) Provisional application No. 61/602,176, filed on Feb. 23, 2012.

(51) Int. Cl.

| | |
|---|---|
| ***E21B 41/04*** | (2006.01) |
| ***C06D 5/00*** | (2006.01) |
| ***F15B 1/08*** | (2006.01) |
| ***F15B 1/24*** | (2006.01) |
| ***E21B 41/00*** | (2006.01) |

(52) U.S. Cl.

CPC ..... *C06D 5/00* (2013.01); *E21B 41/0007* (2013.01); *F15B 1/08* (2013.01); *F15B 1/24* (2013.01); *F15B 2201/20* (2013.01); *F15B 2201/205* (2013.01)

(58) Field of Classification Search

CPC . E21B 33/0355; E21B 33/064; E21B 33/038; B63C 11/52

USPC ..... 166/335, 363, 376, 63; 102/531

See application file for complete search history.

(56) References Cited

U.S. PATENT DOCUMENTS

| | | | | |
|---|---|---|---|---|
| 3,100,058 | A * | 8/1963 | Peet | 220/89.2 |
| 4,461,322 | A * | 7/1984 | Mills | 138/31 |
| 5,004,154 | A * | 4/1991 | Yoshida et al. | 239/96 |
| 5,072,896 | A * | 12/1991 | McIntyre et al. | 244/122 AF |
| 5,647,734 | A * | 7/1997 | Milleron | 417/380 |
| 2009/0178433 | A1 * | 7/2009 | Kumakura et al. | 62/402 |
| 2009/0211239 | A1 * | 8/2009 | Askeland | 60/327 |

OTHER PUBLICATIONS

International Search Report and Written Opinion for PCT/US2013/27680 dated May 8, 2013.

* cited by examiner

*Primary Examiner* — Matthew Buck
*Assistant Examiner* — Patrick Lambe
(74) *Attorney, Agent, or Firm* — Winstead PC

(57) ABSTRACT

A pyrotechnic pressure accumulator includes an elongated body extending from a first end of a pyrotechnic section to a discharge end of a hydraulic section. A propellant charge located in a gas chamber of the pyrotechnic section, a piston movably disposed the hydraulic section, and a fluid disposed in a hydraulic chamber between the piston and the discharge end, wherein the fluid is exhausted under pressure through a discharge port in response to ignition of the propellant charge.

19 Claims, 8 Drawing Sheets

PYROTECHNIC PRESSURE ACCUMULATOR

BACKGROUND

This section provides background information to facilitate a better understanding of the various aspects of the disclosure. It should be understood that the statements in this section of this document are to be read in this light, and not as admissions of prior art.

Pre-charged hydraulic accumulators are utilized in many different industrial applications to provide a source of hydraulic pressure and operating fluid to actuate devices such as valves. It is common for installed hydraulic accumulators to be connected to or connectable to a source of hydraulic pressure to recharge the hydraulic accumulator due to leakage and/or uses.

SUMMARY

According to one or more aspects, a pyrotechnic pressure accumulator includes an elongated body extending from a first end of a pyrotechnic section to a discharge end of a hydraulic section. A propellant charge located in a gas chamber of the pyrotechnic section, a piston movably disposed in the hydraulic section, and a fluid disposed in a hydraulic chamber between the piston and the discharge end, wherein the fluid is exhausted under pressure through a discharge port in response to ignition of the propellant charge. According to an embodiment, the piston has a pyrotechnic end oriented toward the propellant charge and having a ballistic seal and a hydraulic end oriented toward the discharge end and having a hydraulic seal. The pyrotechnic pressure accumulator can include a pressure control device located between the propellant charge and the piston, wherein the pressure control device comprises an orifice formed through a barrier.

A pyrotechnic pressure accumulator according to one or more aspects includes an elongated body extending from a first end of a pyrotechnic section to a discharge end of a hydraulic section. A breech chamber located in the pyrotechnic section between the first end and a breech barrier having a breech orifice, and a propellant charge located in the breech chamber. A snubbing chamber formed in the pyrotechnic section between the breech barrier and a snubbing barrier having a snubbing orifice. A piston movably disposed in the hydraulic section and a fluid disposed in a hydraulic chamber between the piston and the discharge end, wherein the fluid is exhausted under pressure through a discharge port in response to ignition of the propellant charge A method according to one or more aspects includes activating a pyrotechnic pressure accumulator to supply a hydraulic pressure to device in a subsea well system, the pyrotechnic pressure accumulator according to one or more embodiments having an elongated body extending from a first end of a pyrotechnic section to a discharge end of a hydraulic section, a propellant charge located in a gas chamber of the pyrotechnic section, a piston movably disposed in the hydraulic section, and a fluid disposed in a hydraulic chamber between the piston and the discharge end. Igniting the propellant charge and pressurizing the fluid and discharging the pressurized fluid through a discharge port to the device in response to igniting the propellant charge.

The foregoing has outlined some of the features and technical advantages in order that the detailed description of the pyrotechnic pressure accumulator that follows may be better understood. Additional features and advantages of the pyrotechnic pressure accumulator will be described hereinafter which form the subject of the claims of the invention. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
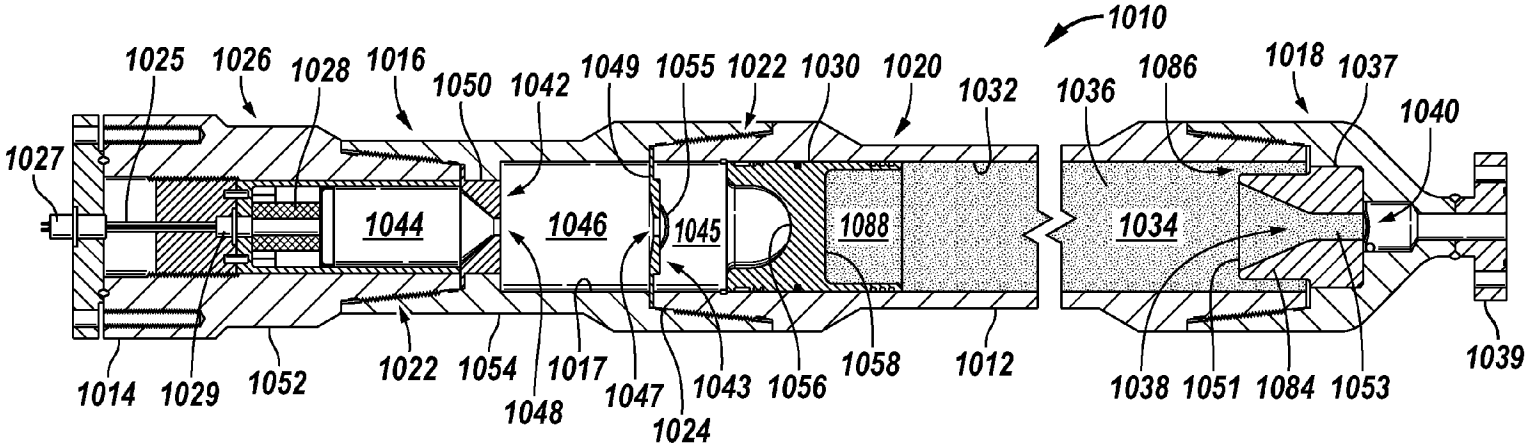
FIG. 1 is a schematic view of a pyrotechnic pressure accumulator according to one or more aspects of the disclosure.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

A pyrotechnic pressure device is disclosed that provides a useable storage of hydraulic fluid that can pressurized for use on demand. The pyrotechnic pressure device, referred to herein as an accumulator, can be utilized to establish the necessary hydraulic power to drive and operate hydraulic and mechanical devices and systems and it may be utilized in conjunction with or in place of pre-charged hydraulic accumulators. Example of utilization of the pyrotechnic pressure accumulator are described with reference to subsea well systems, in particular safety systems; however, use of the pyrotechnic pressure accumulator is not limited to subsea systems and environments. For example, and without limitation, hydraulic accumulators are utilized to operate valves, bollards, pipe rams, and pipe shears. According to embodiments disclosed herein, the pyrotechnic pressure accumulator can be located subsea and remain in place without requiring hydraulic pressure recharging. In addition, when located for example subsea the pyrotechnic hydraulic accumulator does not require charging by high pressure hydraulic systems located at the surface.

FIG. 1 is a sectional view of an example of a pyrotechnic pressure device, generally denoted by the numeral 1010, according to one or more embodiments. As will be understood by those skilled in the art with benefit of this disclosure, pyrotechnic pressure device 1010, also referred to as a pyrotechnic pressure accumulator, may be utilized in many different applications to provide hydraulic pressure at a desired operating or working pressure to a connected device.

In the example of FIG. 1, pyrotechnic pressure accumulator 1010 comprises an elongated body 1012 extending substantially from a first end 1014 of pyrotechnic section 1016 to a discharge end 1018 of a hydraulic section 1020. As will be understood by those skilled in the art with benefit of this disclosure, body 1012 may be constructed of one or more sections (e.g., tubular sections). In the depicted embodiment, pyrotechnic section 1016 and hydraulic section 1020 are connected at a threaded joint 1022 (e.g., double threaded) having a seal 1024. In the depicted embodiment, threaded joint 1022 provides a high pressure seal (e.g., hydraulic seal and/or gas seal).

A pressure generator 1026 (i.e., gas generator), comprising a pyrotechnic (e.g., propellant) charge 1028, is connected at first end 1014 and disposed in the gas chamber 1017 (i.e., expansion chamber) of pyrotechnic section 1016. In the depicted embodiment, pressure generator 1026 comprises an initiator (e.g., ignitor) 1029 connected to pyrotechnic charge 1028 and extending via electrical conductor 1025 to an electrical connector 1027. In this example, electrical connector 1027 is wet-mate connector for connecting to an electrical source for example in a sub-sea, high pressure environment.

A piston 1030 is moveably disposed within a bore 1032 of the hydraulic section 1020 of body 1012. A hydraulic fluid chamber 1034 is formed between piston 1030 and discharge end 1018. Hydraulic chamber 1034 is filled with a fluid 1036, e.g., non-compressible fluid, e.g., oil, water, or gas. Fluid 1036 is generally described herein as a liquid or hydraulic fluid, however, it is understood that a gas can be utilized for some embodiments. Hydraulic chamber 1034 can be filled with fluid 1036 for example through a port. Fluid 1036 is not pre-charged and stored in hydraulic chamber 1034 at the operating pressure.

A discharge port 1038 is in communication with discharge end 1018 to communicate the pressurized fluid 1036 to a connected operational device (e.g., valve, rams, bollards, etc.). In the depicted embodiment, discharge port 1038 is formed by a member 1037, referred to herein as cap 1037, connected at discharge end 1018 for example by a bolted flange connection. A flow control device 1040 is located in the fluid flow path of discharge port 1038. In this example, flow control device 1040 is a one-way valve (i.e., check valve) permitting fluid 1036 to be discharged from fluid hydraulic chamber 1034 and blocking backflow of fluid into hydraulic chamber 1034. A connector 1039 (e.g., flange) is depicted at discharge end 1018 to connect hydraulic chamber 1034 to an operational device for example through an accumulator manifold. According to embodiments, pyrotechnic pressure accumulator 1010 is adapted to be connected to a subsea system for example by a remote operated vehicle.

Upon ignition of pyrotechnic charge 1028, high pressure gas expands in gas chamber 1017 and urges piston 1030 toward discharge end 1018 thereby pressurizing fluid 1036 and exhausting the pressurized fluid 1036 through discharge end 1018 and flow control device 1040 to operate the connected operational device.

Figure 2:
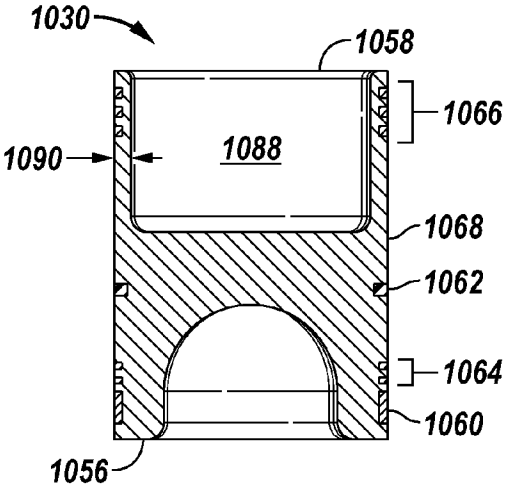
FIG. 2 is a schematic illustration of a piston according to one or more aspects of the disclosure.

Piston 1030, referred to also as a hybrid piston, is adapted to operate in a pyrotechnic environment and in a hydraulic environment. A non-limiting example of piston 1030 is described with reference to FIGS. 1 and 2. Piston 1030, depicted in FIGS. 1 and 2, includes a pyrotechnic end, or end section, 1056 and a hydraulic end, or end section 1058. Pyrotechnic end 1056 faces pyrotechnic charge 1028 and hydraulic end 1058 faces discharge end 1018. Piston 1030 may be constructed of a unitary body or may be constructed in sections (see, e.g., FIGS. 3-5) of the same or different material. In this embodiment, piston 1030 comprises a ballistic seal (i.e., obturator seal) 1060, a hydraulic seal 1062, and a first and a second piston ring set 1064, 1066. According to an embodiment, ballistic seal 1060 is located on outer surface 1068 of pyrotechnic end 1056 of piston 1030. Ballistic seal 1060 may provide centralizing support for piston 1030 in bore 1032 and provide a gas seal to limit gas blow by (e.g., depressurization). First piston ring set 1064 is located adjacent to ballistic seal 1060 and is separated from the terminal end of pyrotechnic end 1056 by ballistic seal 1060. Second piston ring set 1066 is located proximate the terminal end of hydraulic end section 1058. A hydraulic seal 1062 is located between first piston ring set 1064 and second piston ring set 1066 in this non-limiting example of piston 1030.

According to some embodiments, one or more pressure control devices 1042 are positioned in gas chamber 1017 for example to dampen the pressure pulse and/or to control the pressure (i.e., operating or working pressure) at which fluid 1036 is exhausted from discharge port 1038. In the embodiment depicted in FIG. 1, gas chamber 1017 of pyrotechnic section 1016 includes two pressure control devices 1042, 1043 dividing gas chamber 1017 into three chambers 1044, 1046 and 1045. First chamber 1044, referred to also as breech chamber 1044, is located between first end 1014 (e.g., the connected gas generator 1026) and first pressure control device 1042 and a snubbing chamber 1046 is formed between pressure control devices 1042, 1043. Additional snubbing chambers can be provided when desired.

First pressure control device 1042 comprises an orifice 1048 formed through a barrier 1050 (e.g., orifice plate). Barrier 1050 may be constructed of a unitary portion of the body of pyrotechnic section 1016 or it may be a separate member connected with pyrotechnic section. Second pressure control device 1043 comprises an orifice 1047 formed through a barrier 1049. Barrier 1049 may be a continuous or unitary portion of the body of pyrotechnic section 1016 or may be a separate member connected within the pyrotechnic section. The size of orifices 1048, 1047 can be sized to provide the desired working pressure of the discharged hydraulic fluid 1036.

Figure 3:
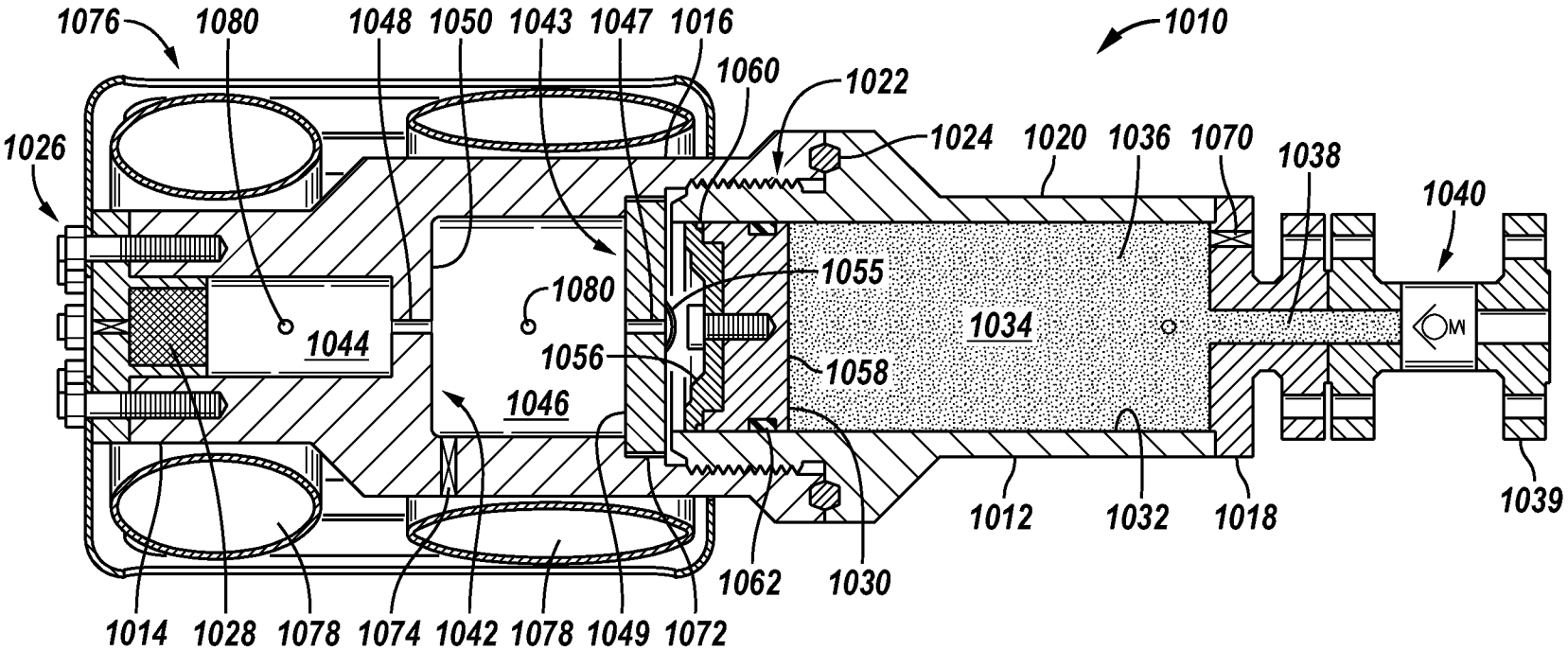
FIG. 3 is schematic illustration of a pyrotechnic pressure accumulator depicted in a first position prior to being activated.
Figure 4:
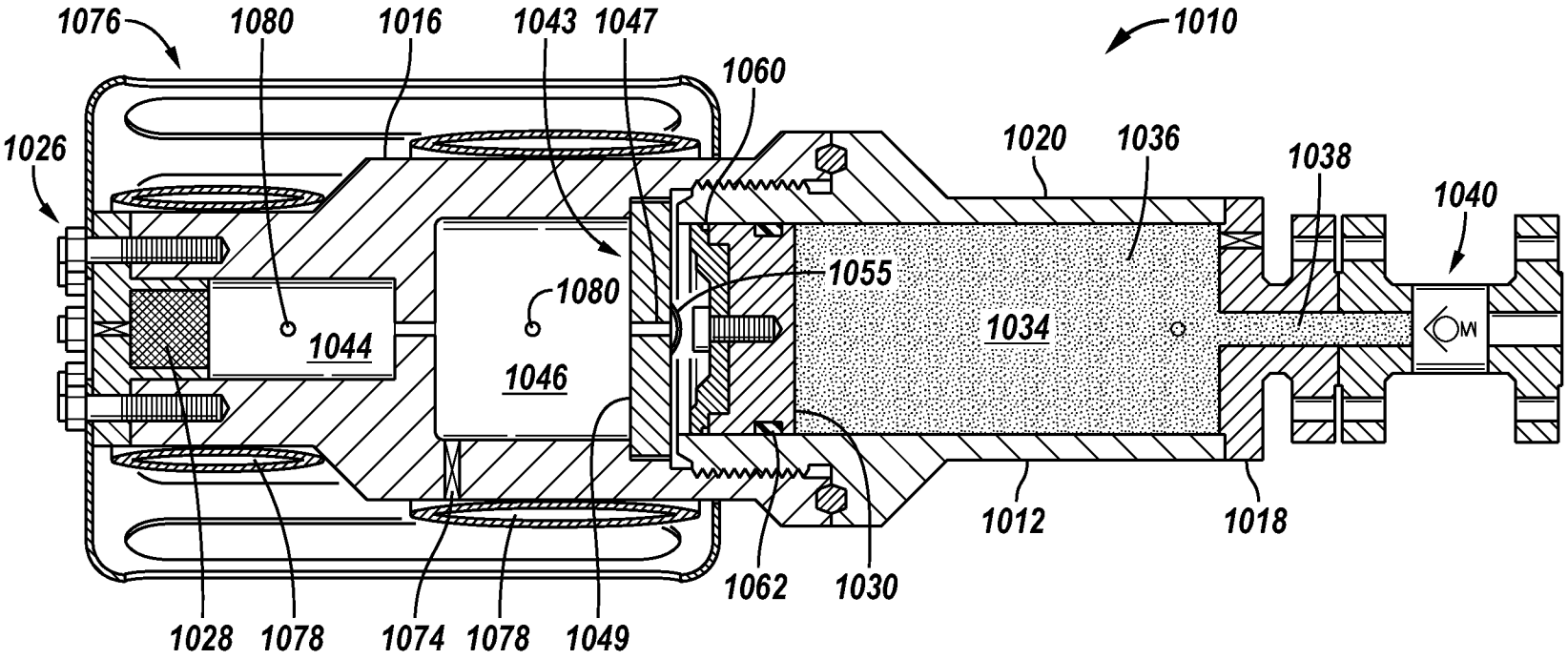
FIG. 4 is a schematic illustration of a pyrotechnic pressure accumulator prior to being activated and depicted in a second position having higher external environmental pressure than the first position of FIG. 3.
Figure 5:
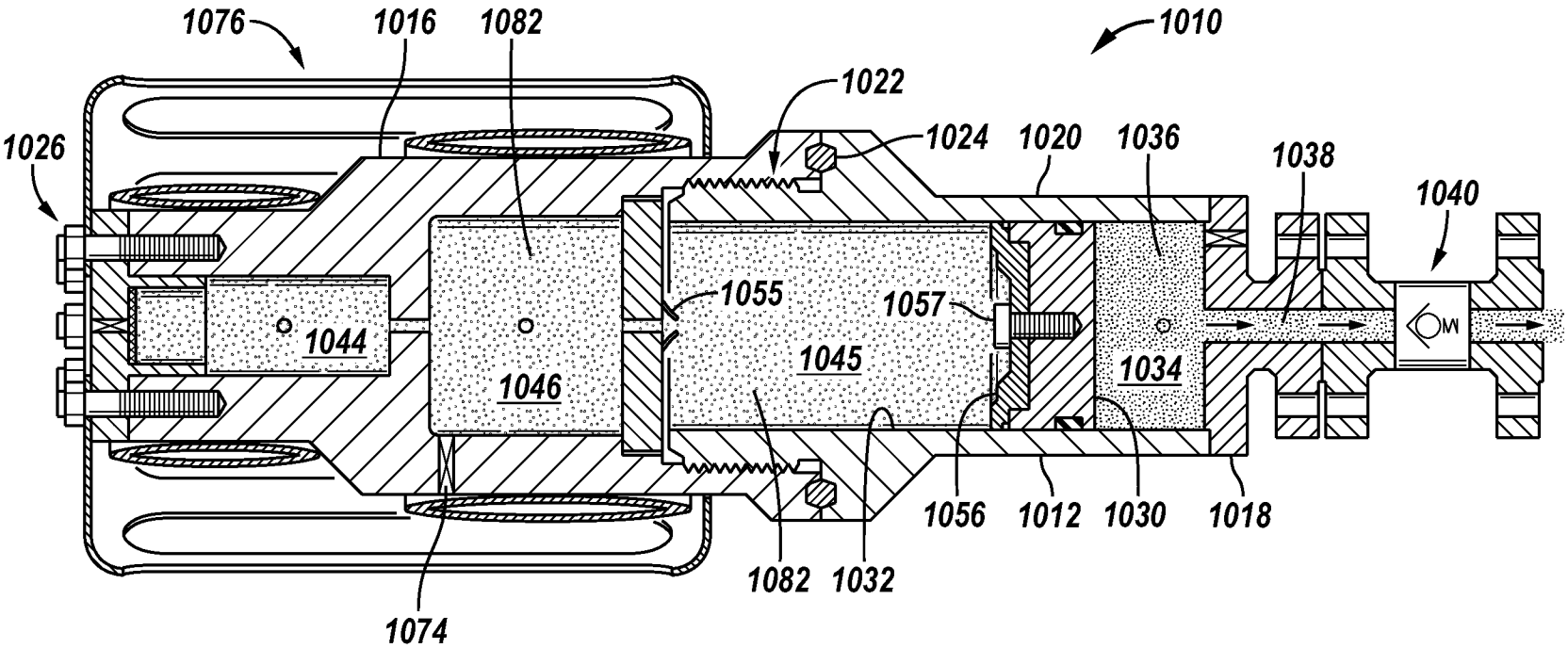
FIG. 5 is schematic illustration of a pyrotechnic pressure accumulator after being activated according to one or more aspects of the disclosure.

For example, in FIG. 1 pyrotechnic section 1016 includes two interconnected tubular sections or subs. In this embodiment, the first tubular sub 1052 (e.g., breech sub), includes first end 1014 and breech chamber 1044. The second tubular sub 1054, also referred to as snubbing sub 1054, forms snubbing chamber 1046 between the first pressure control device 1042, i.e., breech orifice, and the second pressure control device 1043, i.e., snubbing orifice. For example, piston 1030 and snubbing pressure control device 1043 may be inserted at the threaded joint 1022 between hydraulic section 1020 and snubbing sub 1054 as depicted in FIG. 1, formed by a portion of body 1012, and or secured for example by soldering or welding as depicted in FIGS. 3-5 (e.g., connector 1072, FIG. 3). The breech pressure control device 1042 can be inserted at the threaded joint 1022 between breech sub 1052 and snubbing sub 1054. In the FIG. 1 embodiment, barrier 1050 and/or barrier 1049 may be retained between the threaded connection 1022 of adjacent tubular sections of body 1012 and/or secured for example by welding or soldering (e.g., connector 1072 depicted in FIG. 3).

In the embodiment of FIG. 1, a rupture device 1055 closes an orifice 1048, 1047 of at least one of pressure control devices 1042, 1043. In the depicted example, rupture device 1055 closes orifice 1047 of second pressure control device 1043, adjacent to hydraulic section 1020, until a predetermined pressure differential across rupture device 1055 is achieved by the ignition of pyrotechnic charge 1028. Rupture device 1055 provides a seal across orifice 1047 prior to connecting pyrotechnic section 1016 with hydraulic section 1020 and during pyrotechnic pressure accumulator 1010 inactivity, for example to prevent fluid 1036 leakage to seep into pyrotechnic section 1016.

According to some embodiments, a pressure compensation device (see, e.g., FIGS. 3-5) may be connected for example with gas chamber 1017 of pyrotechnic section 1016. When being located subsea, the pressure compensation device substantially equalizes the pressure in gas chamber 1017 with the environmental hydrostatic pressure.

According to one or more embodiments, pyrotechnic pressure accumulator 1010 may provide a hydraulic cushion to mitigate impact of piston 1030 at discharge end 1018, for example against cap 1037. In the example depicted in FIG. 1, the cross-sectional area of discharge port 1038 decreases from an inlet end 1051 to the outlet end 1053. The tapered discharge port 1038 may act to reduce the flow rate of fluid 1036 through discharge port 1038 as piston 1030 approaches discharge end 1018 and providing a fluid buffer that reduces the impact force of piston 1030 against cap 1037.

A hydraulic cushion at the end of the stroke of piston 1030 may be provided for example, by a mating arrangement of piston 1030 and discharge end 1018 (e.g., cap 1037). For example, as illustrated in FIG. 1 and with additional reference to FIG. 2, end cap 1037 includes a sleeve section 1084 disposed inside of bore 1032 of hydraulic section 1020. Sleeve section 1084 has a smaller outside diameter than the inside diameter of bore 1032 providing an annular gap 1086. Piston 1030 has a cooperative hydraulic end 1058 that forms a cavity 1088 having an annular sidewall 1090 (e.g., skirt). Annular sidewall 1090 is sized to fit in annular gap 1086 disposed inlet end 1051 and sleeve 1084 in cavity 1088. Hydraulic fluid 1036 disposed in gap 1086 will cushion the impact of piston 1030 against end cap 1037. It is to be noted that discharge port 1038 does not have to be tapered to provide a hydraulic cushion.

In some embodiments (e.g., see FIGS. 3-5), hydraulic chamber 1034 may be filled with a volume of fluid 1036 in excess of the volume required for the particular installation of accumulator 1010. The excess volume of fluid 1036 can provide a cushion separating piston 1030 from discharge end 1018 at the end of the stroke of piston 1030.

FIG. 3 is a sectional view of a pyrotechnic pressure accumulator 1010 according to one or more embodiments illustrated in a first position for example prior to being deployed at a depth subsea. Pyrotechnic pressure accumulator 1010 comprises an elongated body 1012 extending from a first end 1014 of a pyrotechnic section 1016 to discharge end 1018 of a hydraulic section 1020. In the depicted example pyrotechnic section 1016 and hydraulic section 1020 are connected at a threaded joint 1022 having at least one seal 1024.

Hydraulic section 1020 comprises a bore 1032 in which a piston 1030 (i.e., hybrid piston) is movably disposed. Piston 1030 comprises a pyrotechnic end section 1056 having a ballistic seal 1060 and hydraulic end section 1058 having a hydraulic seal 1062. In the depicted embodiment, piston 1030 is a two-piece construction. Pyrotechnic end section 1056 and hydraulic end section 1058 are depicted coupled together by a connector, generally denoted by the numeral 1057 in FIG. 5. Connector 1057 is depicted as a bolt, e.g., threaded bolt, although other attaching devices and mechanism (e.g., adhesives may be utilized). Hydraulic chamber 1034 is formed between piston 1030 and discharge end 1018. A flow control device 1040 is disposed with discharge port 1038 of discharge end 1018 substantially restricting fluid flow to one-direction from hydraulic chamber 1034 through discharge port 1038.

Hydraulic chamber 1034 may be filled with hydraulic fluid 1036 for example through discharge port 1038. Port 1070 (e.g., valve) is utilized to relieve pressure from hydraulic chamber 1034 during fill operations or to drain fluid 1036 for example if an un-actuated pyrotechnic pressure accumulator 1010 is removed from a system.

In the depicted embodiment, pyrotechnic section 1016 includes a breech chamber 1044 and a snubbing chamber 1046. Gas generator 1026 is illustrated connected, for example by bolted interface, to first end 1014 disposing pyrotechnic charge 1028 into breech chamber 1044. Breech chamber 1044 and snubbing chamber 1046 are separated by pressure control device 1042 which is illustrated as an orifice 1048 formed through breech barrier 1050. In this non-limiting example, breech barrier 1050 is formed by a portion of body 1012 forming pyrotechnic section 1016. Breech orifice 1048 can be sized for the desired operating pressure of pyrotechnic pressure accumulator 1010.

Snubbing chamber 1046 is formed in pyrotechnic section 1016 between barrier 1050 and a snubbing barrier 1049 of second pressure control device 1043. Pressure control device 1043 has a snubbing orifice 1047 formed through snubbing barrier 1049. In the illustrated embodiment, snubbing barrier 1049 may be secured in place by a connector 1072. In this example, connector 1072 is a solder or weld to secure barrier 1049 (i.e., plate) in place and provide additional sealing along the periphery of barrier 1049. Snubbing orifice 1047 may be sized for the fluid capacity and operating pressure of the particular pyrotechnic pressure accumulator 1010 for example to dampen the pyrotechnic charge pressure pulse. A rupture device 1055 is depicted disposed with the orifice 1047 to seal the orifice and therefore gas chambers 1044, 1046 during inactivity of the deployed pyrotechnic pressure accumulator 1010. Rupture device 1055 can provide a clear opening during activation of pyrotechnic pressure accumulator 1010 and burning of charge 1028.

A vent 1074, i.e., valve, is illustrated in communication with gas chamber 1017 to relieve pressure from the gas chambers prior to disassembly after pyrotechnic pressure accumulator 1010 has been operated.

FIGS. 3 to 5 illustrate a pressure compensation device 1076 in operational connection with the gas chambers, breech chamber 1044 and snubbing chamber 1046, to increase the pressure in the gas chambers in response to deploying pyrotechnic pressure accumulator 1010 subsea. In the depicted embodiment, pressure compensator 1076 includes one or more devices 1078 (e.g. bladders) containing a gas (e.g., nitrogen). Bladders 1078 are in fluid connection with gas chambers 1017 (e.g., chambers 1044, 1046, etc.) for example through ports 1080.

Refer now to FIG. 4, wherein pyrotechnic pressure accumulator 1010 is depicted deployed subsea (see, e.g., FIGS. 6-8) prior to being activated. In response to the hydrostatic pressure at the subsea depth of pyrotechnic pressure accumulator bladders 1078 have deflated thereby pressurizing breech chamber 1044 and snubbing chamber 1046.

FIG. 5 illustrates an embodiment of pyrotechnic pressure accumulator 1010 after being activated. With reference to FIGS. 4 and 5, pyrotechnic pressure accumulator 1010 is activated by igniting pyrotechnic charge 1028. The ignition generates gas 1082 which expands in breech chamber 1044 and snubbing chamber 1046. The pressure in the gas chambers ruptures rupture device 1055 and the expanding gas acts on pyrotechnic side 1056 of piston 1030. Piston 1030 is moved toward discharge end 1018 in response to the pressure of gas 1082 thereby discharging pressurized fluid 1036 through discharge port 1038 and flow control device 1040. In FIG. 5, piston 1030 is illustrated spaced a distance apart from discharge end 1018. In accordance to one or more embodiments, at least a portion of the volume of fluid 1036 remaining in hydraulic fluid chamber 1034 is excess volume supplied to provide a space (i.e., cushion) between piston 1030 and discharge end 1018 at the end of the stroke of piston 1030.

Pyrotechnic pressure accumulator 1010 can be utilized in many applications wherein an immediate and reliable source of pressurized fluid is required. Pyrotechnic pressure accumulator 1010 provides a sealed system that is resistant to corrosion and that can be constructed of material for installation in hostile environments. Additionally, pyrotechnic pressure accumulator 1010 can provide a desired operating pressure level without regard to the ambient environmental pressure.

A method of operation and is now described with reference to FIGS. 6-9 which illustrate a subsea well system in which one or more pyrotechnic pressure accumulators are utilized. An example of a subsea well system is described in U.S. patent application publication No. 2012/0048566, which is incorporated by reference herein.

Figure 6:
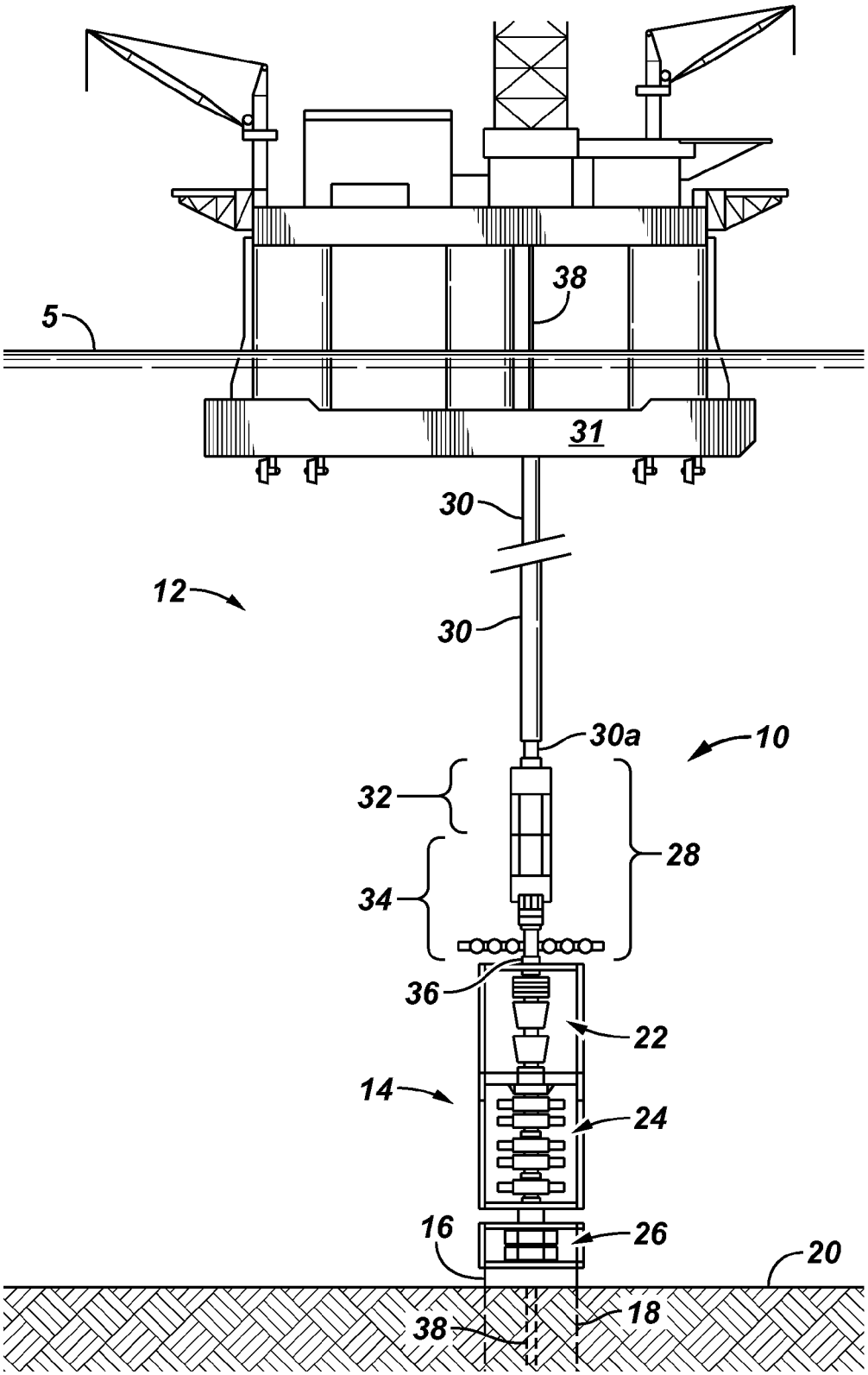
FIGS. 6 and 7 illustrated a subsea well system and subsea well safety system in which a pyrotechnic pressure accumulator according to one or more aspects of the disclosure can be utilized.

FIG. 6 is a schematic illustration of a subsea well safing system, generally denoted by the numeral 10, being utilized in a subsea well drilling system 12. In the depicted embodiment drilling system 12 includes a BOP stack 14 which is landed on a subsea wellhead 16 of a well 18 (i.e., wellbore) penetrating seafloor 20. BOP stack 14 conventionally includes a lower marine riser package ("LMRP") 22 and blowout preventers ("BOP") 24. The depicted BOP stack 14 also includes subsea test valves ("SSTV") 26. As will be understood by those skilled in the art with benefit of this disclosure, BOP stack 14 is not limited to the devices depicted.

Figure 7:
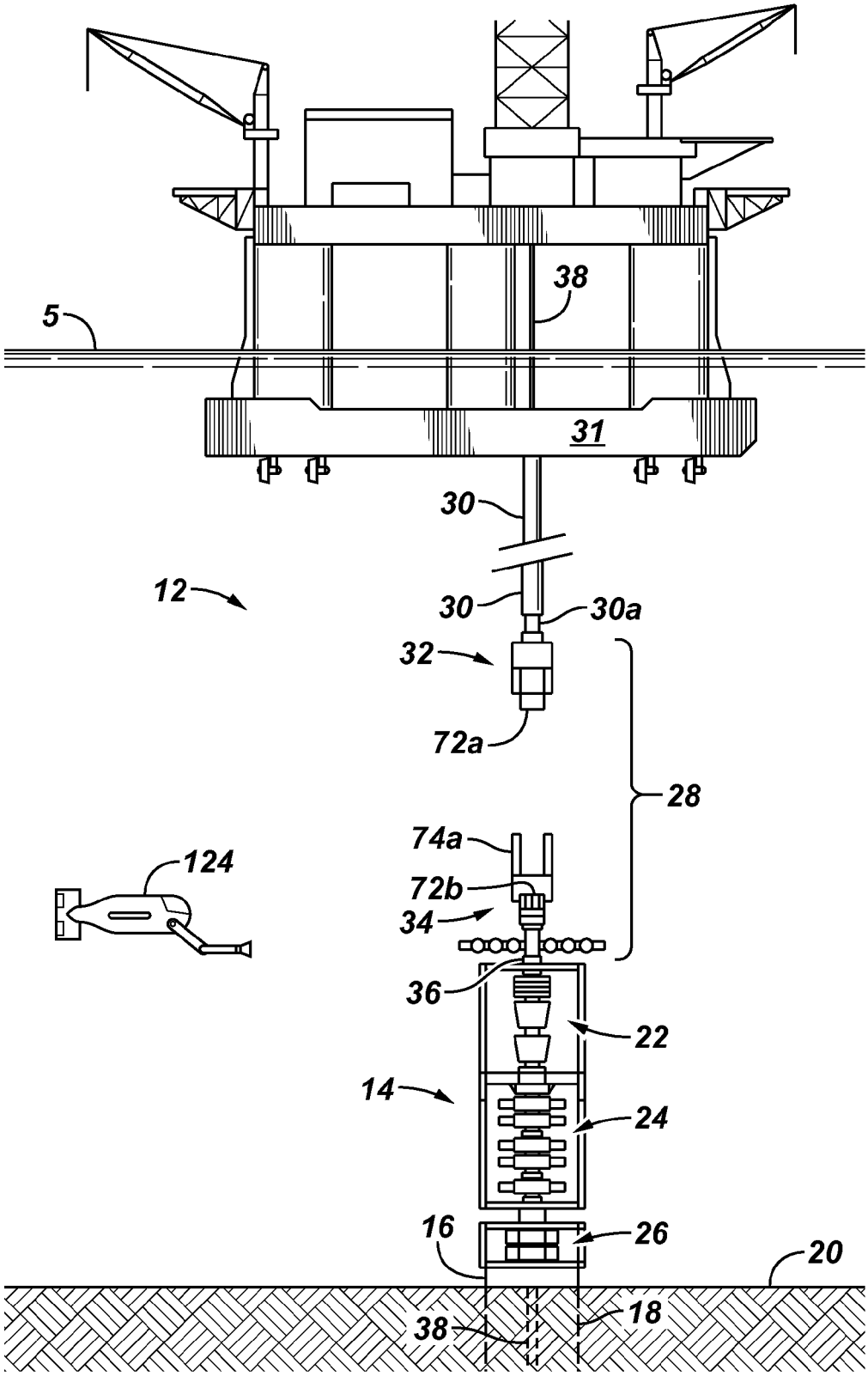

Subsea well safing system 10 comprises safing package, or assembly, referred to herein as a catastrophic safing package ("CSP") 28 that is landed on BOP system 14 and operationally connects a riser 30 extending from platform 31 (e.g., vessel, rig, ship, etc.) to BOP stack 14 and thus well 18. CSP 28 comprises an upper CSP 32 and a lower CSP 34 that are adapted to separate from one another in response to initiation of a safing sequence thereby disconnecting riser 30 from the BOP stack 14 and well 18, for example as illustrated in FIG. 7. The safing sequence is initiated in response to parameters indicating the occurrence of a failure in well 18 with the potential of leading to a blowout of the well. Subsea well safing system 10 may automatically initiate the safing sequence in response to the correspondence of monitored parameters to selected safing triggers. According to one or more embodiments, CSP 28 includes one or more pyrotechnic pressure accumulators 1010 (see, e.g., FIGS. 8 and 9) to provide hydraulic pressure on demand to operate one or more of the well system devices (e.g., valves, connectors, ejector bollards, rams, and shears).

Wellhead 16 is a termination of the wellbore at the seafloor and generally has the necessary components (e.g., connectors, locks, etc.) to connect components such as BOPs 24, valves (e.g., test valves, production trees, etc.) to the wellbore. The wellhead also incorporates the necessary components for hanging casing, production tubing, and subsurface flow-control and production devices in the wellbore.

LMRP 22 and BOP stack 24 are coupled together by a connector that is engaged with a corresponding mandrel on the upper end of BOP stack 24. LMRP 22 typically provides the interface (i.e., connection) of the BOPs 24 and the bottom end 30*a* of marine riser 30 via a riser connector 36 (i.e., riser adapter). Riser connector 36 may further comprise one or more ports for connecting fluid (i.e., hydraulic) and electrical conductors, i.e., communication umbilical, which may extend along (exterior or interior) riser 30 from the drilling platform located at surface 5 to subsea drilling system 12. For example, it is common for a well control choke line 44 and a kill line 46 to extend from the surface for connection to BOP stack 14.

Riser 30 is a tubular string that extends from the drilling platform 31 down to well 18. The riser is in effect an extension of the wellbore extending through the water column to drilling vessel 31. The riser diameter is large enough to allow for drillpipe, casing strings, logging tools and the like to pass through. For example, in FIGS. 6 and 7, a tubular 38 (e.g., drillpipe) is illustrated deployed from drilling platform 31 into riser 30. Drilling mud and drill cuttings can be returned to surface 5 through riser 30. Communication umbilical (e.g., hydraulic, electric, optic, etc.) can be deployed exterior to or through riser 30 to CSP 28 and BOP stack 14. A remote operated vehicle ("ROV") 124 is depicted in FIG. 7 and may be utilized for various tasks including installing and removing pyrotechnic pressure accumulators 1010.

Figure 8:
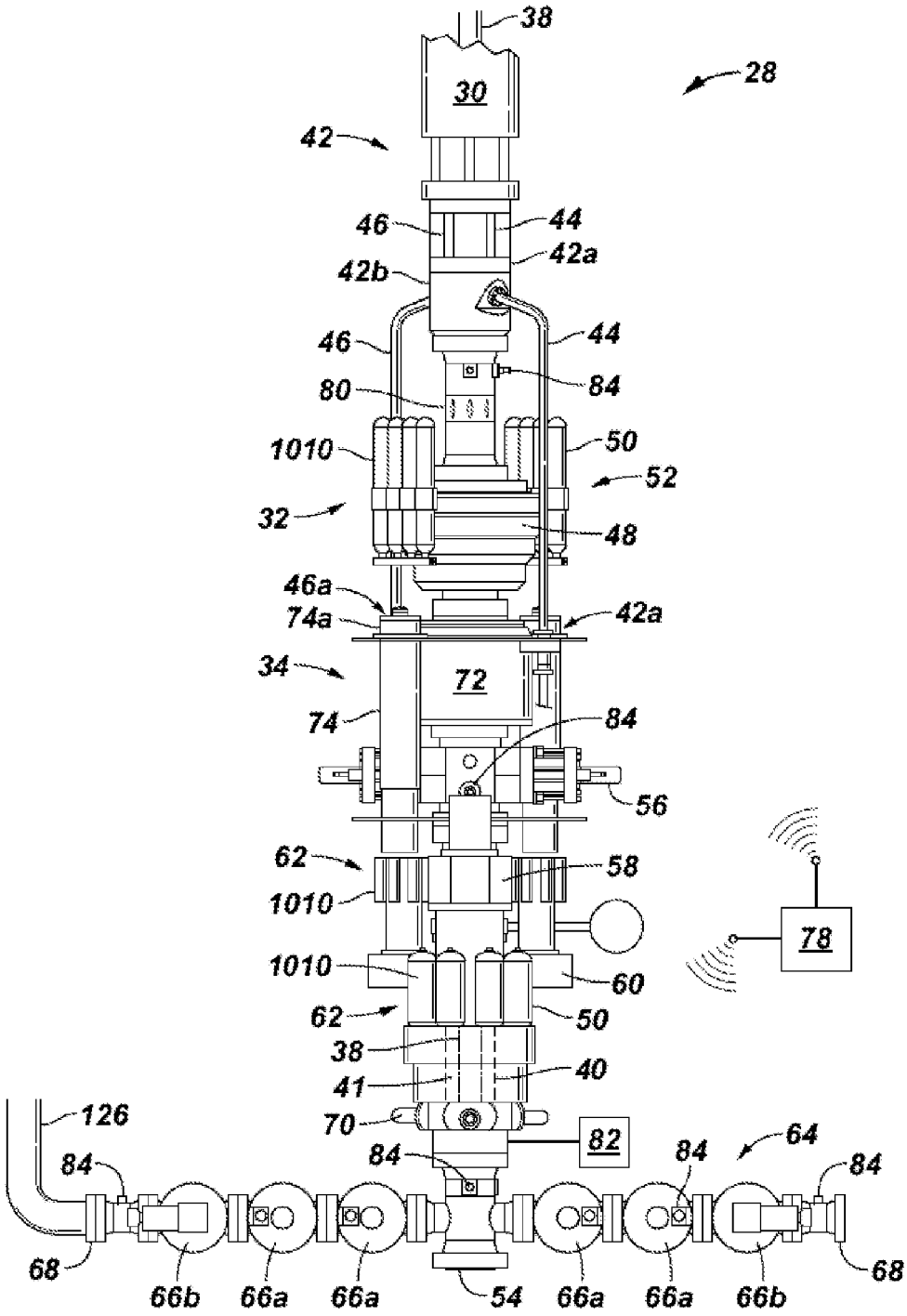
FIG. 8 illustrates a subsea well safety system utilizing a pyrotechnic pressure accumulator according to one or more aspects of the disclosure.

Refer now to FIG. 8 which illustrates a subsea well safing package 28 according to one or more embodiments in isolation. CSP 28 depicted in FIG. 8 is further described with reference to FIGS. 6 and 7. In the depicted embodiment, CSP 28 comprises upper CSP 32 and lower CSP 34. Upper CSP 32 comprises a riser connector 42 which may include a riser flange connection 42*a*, and a riser adapter 42*b* which may provide for connection of communication umbilicals and extension of the communication umbilicals to various CSP 28 devices and/or BOP stack 14 devices. For example, a choke line 44 and a kill line 46 are depicted extending from the surface with riser 30 and extending through riser adapter 42*b* for connection to the choke and kill lines of BOP stack 14. CSP 28 comprises a choke stab 44*a* and a kill line stab 46*a* for interconnecting the upper portion of choke line 44 and kill line 46 with the lower portion of choke line 44 and kill line 46. Stabs 44*a*, 46*a* can provide for disconnecting from the stab and kill lines during safing operations; and during subsequent recovery and reentry operations reconnecting to the choke and kill lines via stabs 44*a*, 46*a*. CSP 28 comprises an internal longitudinal bore 40, depicted in FIG. 8 by the dashed line through lower CSP 34, for passing tubular 38. Annulus 41 is formed between the outside diameter of tubular 38 and the diameter of bore 40.

Upper CSP 32 further comprises slips 48 (i.e., safety slips) adapted to close on tubular 38. Slips 48 are actuated in the depicted embodiment by hydraulic pressure from a hydraulic accumulator 50 and/or a pyrotechnic pressure accumulator 1010. In the depicted embodiment, CSP 28 comprises a plurality of hydraulic accumulators 50 and pyrotechnic pressure accumulators 1010 which may be interconnected in pods, such as upper hydraulic accumulator pod 52. A pyrotechnic pressure accumulator 1010 located in the upper hydraulic accumulator pod 52 is hydraulically connected to one or more devices, such as slips 48.

Lower CSP 34 comprises a connector 54 to connect to BOP stack 14, for example, via riser connector 36, rams 56 (e.g., blind rams), high energy shears 58, lower slips 60 (e.g., bi-directional slips), and a vent system 64 (e.g., valve manifold). Vent system 64 comprises one or more valves 66. In this embodiment, vent system 64 comprise vent valves (e.g., ball valves) 66*a,* choke valves 66*b*, and one or more connection mandrels 68. Valves 66*b* can be utilized to control fluid flow through connection mandrels 68. For example, a recovery riser 126 is depicted connected to one of mandrels 68 for flowing effluent from the well and/or circulating a kill fluid (e.g., drilling mud) into the well.

In the depicted embodiment, lower CSP 34 further comprises a deflector device 70 (e.g., impingement device, shutter ram) disposed above vent system 64 and below lower slips 60, shears 58, and blind rams 56. Lower CSP 34 includes a plurality of hydraulic accumulators 50 and pyrotechnic pressure accumulators 1010 arranged and connected in one or more lower hydraulic pods 62 for operations of various devices of CSP 28. In the embodiment of FIG. 8, a chemical source 76, e.g., methanol, is illustrated for injection into the system for example to prevent hydrate formation.

Upper CSP 32 and lower CSP 34 are detachably connected to one another by a connector 72 including a first connector portion 72*a* disposed with upper CPS 32 and a second connector portion 72*b* disposed with lower CSP 34 as illustrated in FIG. 7. An ejector device 74 (e.g., ejector bollards) is operationally connected between upper CSP 32 and lower CSP 34 to separate upper CSP 32 and riser 30 from lower CSP 34 and BOP stack 14 after connector 72 has been actuated to the unlocked position. Ejector device 74 can be actuated by operation of pyrotechnic pressure accumulator 1010.

CSP 28 includes a plurality of sensors 84 which can sense various parameters, such as and without limitation, temperature, pressure, strain (tensile, compression, torque), vibration, and fluid flow rate. Sensors 84 further includes, without limitation, erosion sensors, position sensors, and accelerometers and the like. Sensors 84 can be in communication with one or more control and monitoring systems, for example forming a limit state sensor package.

According to one or more embodiments of the invention, CSP 28 comprises a control system 78 which may be located subsea, for example at CSP 28 or at a remote location such as at the surface. Control system 78 may comprise one or more controllers which are located at different locations. For example, in at least one embodiment, control system 78 comprise an upper controller 80 (e.g., upper command and control data bus) and a lower controller 82 (e.g., lower command and controller bus). Control system 78 may be connected via conductors (e.g., wire, cable, optic fibers, hydraulic lines) and/or wirelessly (e.g., acoustic transmission) to various subsea devices (e.g., pyrotechnic pressure accumulators 1010) and to surface (i.e., drilling platform 31) control systems.

Figure 9:
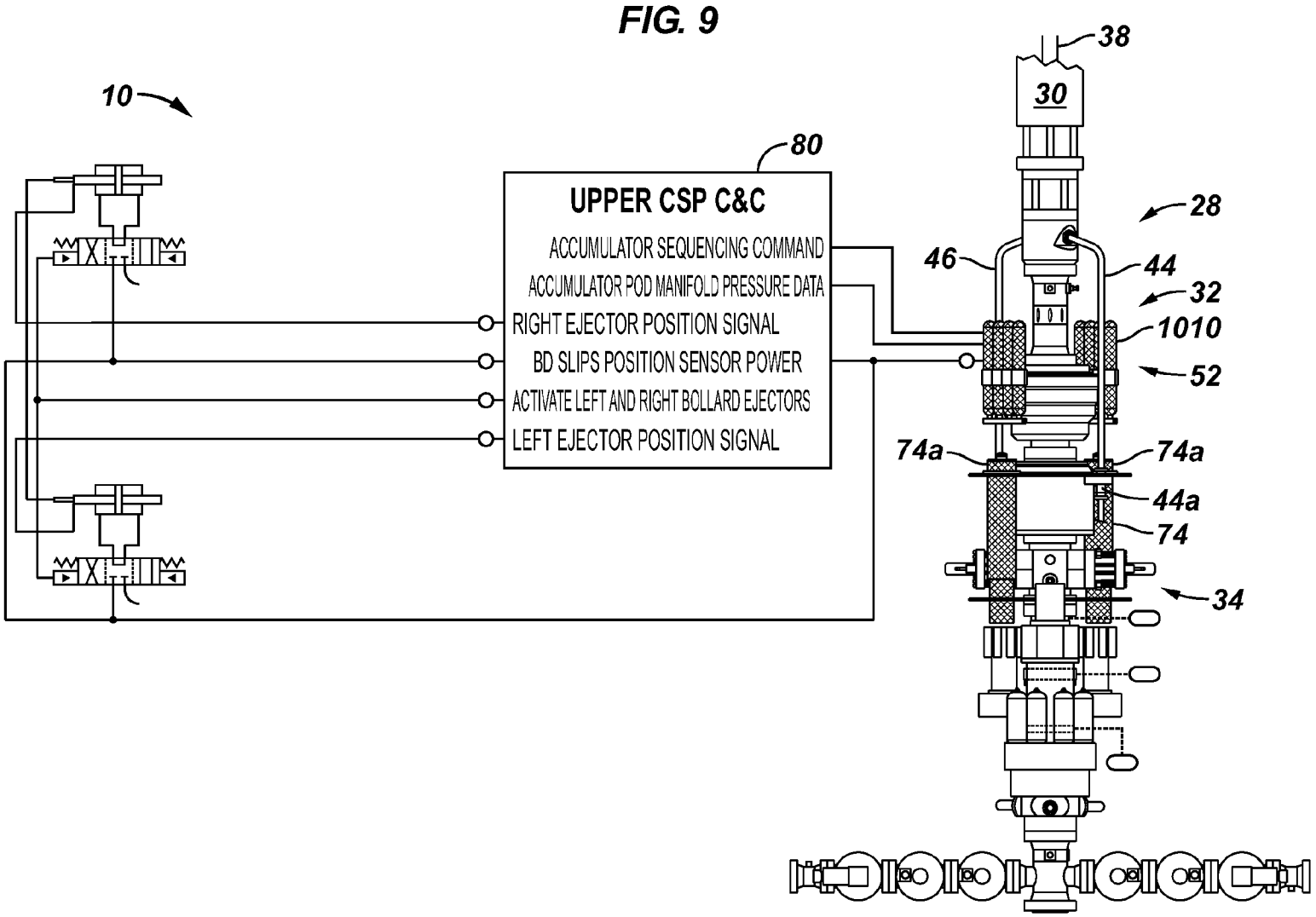
FIG. 9 is a schematic diagram illustrating operation of a pyrotechnic pressure accumulator in accordance with one or more aspects of the disclosure.

FIG. 9 is a schematic diagram of sequence step, according to one or more embodiments of subsea well safing system 10 illustrating operation of ejector devices 74 (i.e., ejector bollards) to physically separate upper CSP 32 and riser 30 from lower CSP 34 as depicted in FIG. 7. For example, ejector devices 74 may include piston rods 74*a* which extend to push the upper CSP 32 away from lower CSP 34 in the depicted embodiment. FIG. 7 illustrates piston rod 74*a* in an extended position. In the embodiment of FIG. 9, actuation of ejector devices 74 is provided by upper controller 80 sending a signal activating a pyrotechnic pressure accumulator 1010 located for example in upper accumulator pod 52 to direct the operating pressure to ejector devices 74.

Referring also to FIGS. 1-5, an electronic signal is transmitted from controller 80 and received at gas generator 1026. The firing signal may be an electrical pulse and/or coded signal. In response to receipt of the firing signal, ignitor 1029 ignites pyrotechnic charge 1028 thereby generating gas 1082 (FIG. 5) that drives piston 1030 toward discharge end 1018 thereby pressurizing fluid 1036 and discharging the pressurized fluid 1036 through discharge port 1038 to ejector device 74. Similarly, pyrotechnic accumulators 1010 can be activated to supply on demand hydraulic pressure to other devices such as, and without limitation to, valves, slips, rams, shears and locks.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A pyrotechnic pressure accumulator for operating a subsea device, comprising:

an elongated body extending axially from a first end of a pyrotechnic section to a discharge end of a hydraulic section;

a propellant charge located in a gas chamber of the pyrotechnic section;

a piston movably disposed in a bore of the hydraulic section;

a fluid disposed in the bore between the piston and the discharge end, wherein the fluid is exhausted under pressure through a discharge port formed through the discharge end in response to ignition of the propellant charge; and a one-way flow control device connected with the discharge port permitting one-way flow from the hydraulic chamber to the subsea device and blocking fluid flow through the discharge port into the hydraulic chamber.

2. The device of claim 1, wherein the piston comprises:

a pyrotechnic end oriented toward the propellant charge and having a ballistic seal; and a hydraulic end oriented toward the discharge end and having a hydraulic seal.

3. The device of claim 1, comprising a pressure control device located axially between the propellant charge and the piston, wherein the pressure control device comprises an orifice formed through a barrier.

4. The device of claim 3, wherein the barrier is connected in the elongated body by a solder or weld.

5. The device of claim 1, comprising:

a pressure control device located axially between the propellant charge and the piston, wherein the pressure control device comprises an orifice formed through a barrier; and a rupture device sealing the orifice prior to ignition of the propellant charge.

6. The device of claim 1, wherein:

the discharge port is disposed through a member extending axially into the hydraulic section from the discharge end, whereby an annular gap is formed about the axially extending member and the elongated body; and the piston comprises:

a hydraulic end oriented toward the discharge end, the hydraulic end having an annular skirt sized to fit into the annular gap.

7. The device of claim 6, comprising:

a pressure control device located axially between the propellant charge and the piston, wherein the pressure control device comprises an orifice formed through a barrier; and a rupture device sealing the orifice prior to ignition of the propellant charge.

8. The device of claim 1, wherein the cross-sectional area of the discharge port decreases from an inlet end to an outlet end.

9. A pyrotechnic pressure accumulator for operating a subsea device, comprising:

an elongated body extending axially from a first end of a pyrotechnic section to a discharge end of a hydraulic section;

a breech chamber located in the pyrotechnic section between the first end and a breech barrier having a breech orifice;

a propellant charge located in the breech chamber;

a snubbing chamber formed in the pyrotechnic section between the breech barrier and a snubbing barrier having a snubbing orifice;

a piston movably disposed in a bore of the hydraulic section;

a fluid disposed in a hydraulic chamber between the piston and the discharge end, wherein the fluid is exhausted under pressure through a discharge port formed through the discharge end in response to ignition of the propellant charge; and a one-way flow control device connected with the discharge port permitting one-way flow from the hydraulic chamber to the subsea device and blocking fluid flow through the discharge port into the hydraulic chamber.

10. The device of claim 9, wherein the pyrotechnic section is connected to the hydraulic section at a threaded joint.

11. The device of claim 9, wherein the breech barrier is a continuous portion of the pyrotechnic section of the elongated body.

12. The device of claim 9, wherein the snubbing barrier is connected in the pyrotechnic section by a solder or weld.

13. The device of claim 9, comprising a bladder in hydraulic communication with the breech chamber to equalize pressure in the breech chamber with external environmental pressure prior to ignition of the propellant charge.

14. The device of claim 9, comprising a rupture device sealing the snubbing orifice prior to ignition of the propellant charge.

15. The device of claim 9, wherein the piston comprises:

a pyrotechnic end oriented toward the propellant charge and having a ballistic seal; and a hydraulic end oriented toward the discharge end and having a hydraulic seal.

16. A method, comprising:

activating a pyrotechnic pressure accumulator to supply a hydraulic pressure to a device in a subsea well system, the pyrotechnic pressure accumulator comprising:

an elongated body extending axially from a first end of a pyrotechnic section to a discharge end of a hydraulic section;

a propellant charge located in a gas chamber of the pyrotechnic section;

a piston movably disposed in a bore of the hydraulic section; and a fluid disposed in the bore between the piston and the discharge end;

igniting the propellant charge;

pressurizing the fluid and discharging the pressurized fluid from the hydraulic section through a discharge port to the device in response to igniting the propellant charge; and blocking fluid flow in the direction into the hydraulic chamber through the discharge port.

17. The method of claim 16, wherein the piston comprises:

a pyrotechnic end oriented toward the propellant charge and having a ballistic seal; and a hydraulic end oriented toward the discharge end and having a hydraulic seal.

18. The method of claim 16, wherein the pyrotechnic accumulator comprises a breech barrier having a breech orifice, the breech barrier located between the propellant charge and the piston.

19. A pyrotechnic pressure accumulator for operating a subsea device, comprising:

an elongated body extending axially from a first end of a pyrotechnic section to a discharge end of a hydraulic section;

a breech chamber located in the pyrotechnic section between the first end and a breech barrier having a breech orifice;

a pyrotechnic located in the breech chamber;

a piston movably disposed in a bore of the hydraulic section between the breech barrier and the discharge end;

a fluid disposed in a hydraulic chamber between the piston and the discharge end, wherein in response to ignition of the pyrotechnic the fluid is exhausted under pressure through a discharge port formed through the discharge end; and a one-way flow control device connected with the discharge port permitting one-way flow from the hydraulic chamber to the subsea device and blocking fluid flow through the discharge port into the hydraulic chamber.

* * * * *